United States Patent [19]

Ito et al.

[11] 4,147,148

[45] Apr. 3, 1979

[54] FUEL CONTROL APPARATUS FOR A DIESEL ENGINE

[75] Inventors: Masami Ito, Toyota; Tsutomu Saito, Hekinan; Yoshiyuki Morita, Kariya, all of Japan

[73] Assignees: Toyota Jidosha Kogyo Kabushiki Kaisha, Toyota; Nippon Denso Company Limited, Kariya, both of Japan

[21] Appl. No.: 834,566

[22] Filed: Sep. 19, 1977

[30] Foreign Application Priority Data

May 19, 1977 [JP] Japan ..... 52-63313[U]

[51] Int. Cl.[2] ..... F02N 17/00

[52] U.S. Cl. ..... 123/179 L; 123/139 ST

[58] Field of Search ..... 123/32 EG, 179 L, 179 G, 123/179 A, 139 ST, 139 AZ, 139 AA, 198 DB

[56] References Cited

U.S. PATENT DOCUMENTS

| | | | |
|---|---|---|---|
| 2,879,754 | 3/1959 | Von Kienlin et al. | 123/139 ST |
| 3,311,102 | 3/1967 | Voigt | 123/179 L |
| 3,533,391 | 10/1970 | Lockmuller | 123/179 A |
| 3,545,418 | 12/1970 | Ballou | 123/179 A |
| 3,614,945 | 10/1971 | Schlagmüller et al. | 123/32 EG |
| 3,690,768 | 9/1972 | Nagasawa | 123/179 L |
| 3,699,941 | 10/1972 | Hughes et al. | 123/179 L |
| 3,786,794 | 1/1974 | Davis | 123/179 L |
| 3,792,693 | 2/1974 | Luchaco | 123/179 L |

*Primary Examiner*—Ira S. Lazarus

*Attorney, Agent, or Firm*—Stevens, Davis, Miller & Mosher

[57] ABSTRACT

A fuel control apparatus for a diesel engine is provided with a control lever which reciprocates between two positions under control of a motor shaft which rotates in one direction only. The control lever connects to a fuel control lever which is moved from a fuel shut-off position to a starting fuel increasing position and then to a normal fuel supply position in accordance with the movement of the control lever. Motor control is effected by relay control in accordance with the positions of a key switch, a pattern switch rotating angularly with the motor shaft, and a switch which determines whether the engine is rotating or at rest.

6 Claims, 9 Drawing Figures

FUEL CONTROL APPARATUS FOR A DIESEL ENGINE

BACKGROUND OF THE INVENTION

This invention relates to a fuel control apparatus for a diesel engine equipped with an electronic diesel injection control system that permits operating a diesel engine in the same way as a gasoline engine.

In a conventional diesel engine having an electronic diesel injection control system a reversible motor has been used to move a control lever of a fuel controller. By changing the motor rotating direction, the lever has been turned in the fuel increasing or decreasing direction. This has complicated not only the electric circuit, but also the mechanical structure due to the need to provide a reversible motor and a clutch.

Accordingly, the object of this invention is to provide a fuel control apparatus which eliminates the aforementioned shortcomings of the conventional control apparatus by providing a unidirectional rotating motor in conjunction with a simple motor control circuit.

BRIEF DESCRIPTION OF THE DRAWINGS

The accompanying drawings are illustrative of an embodiment of this invention.

DESCRIPTION OF THE PREFERRED EMBODIMENT

An embodiment of this invention will now be described by reference to the accompanying drawings.

Figure 1:
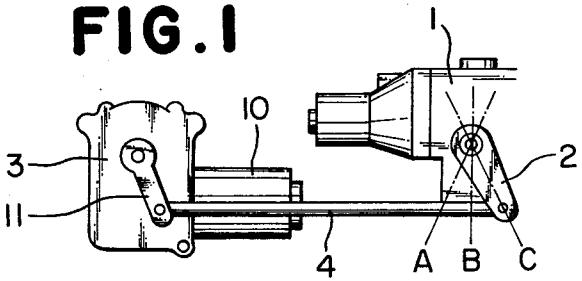
FIG. 1 is a schematic front view showing the apparatus of this invention in use.
Figure 2:
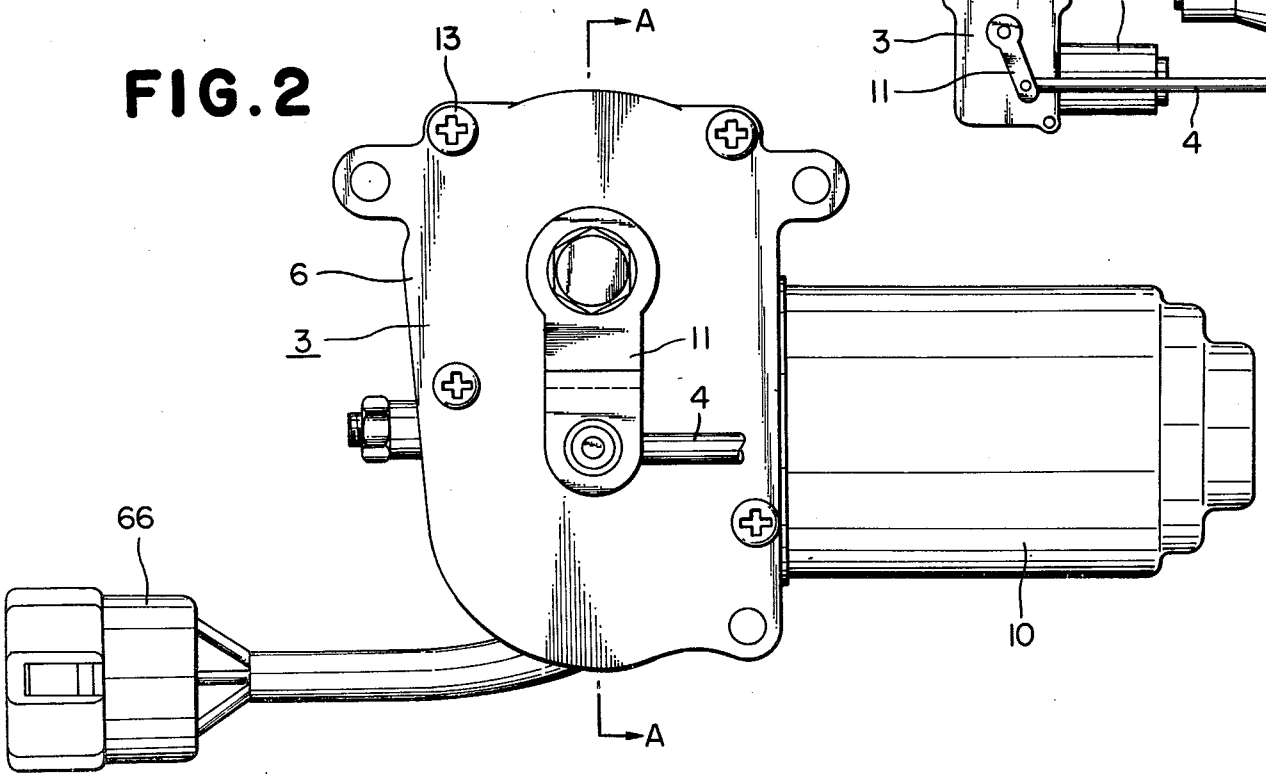
FIG. 2 is an enlarged front view of the apparatus of this invention.

In FIG. 1 a fuel controller 1 increases and decreases the quantity of fuel injected in accordance with the position of its control lever 2. When the control lever 2 is in the leftmost position A the fuel supply is increased for starting, in the middle position B fuel for normal operation is supplied, and in the rightmost position C fuel supply is shut off. Reference numeral 3 designates a fuel control apparatus according to this invention which switches the lever 2 to the position A, B or C through a connecting link 4 by the operation of a key switch.

As shown in FIGS. 2 through 5, the fuel control apparatus 3 comprises a mechanical assembly 8 and a pattern switch 9 constituting part of an electric circuit, which are contained in a closed chamber 7 formed by a case 5 and a cover 6. A direct-current motor 10 on the outside of the case 5 drives the mechanical assembly 8, whereby a lever 1 projecting outward from the cover 6 is reciprocated.

The cover 6 is fixed with screws 13 to the flange 12 of the case 5. By fitting the inwardly projecting cover edge 14 so as to contact the internal edge of the case 5, the cover 6 is fixedly positioned with respect to the case 5. Item 15 is a packing for sealing.

The mechanical assembly 8 comprises a rotating shaft 20 supported by a metal bearing 17 fitted in an annular projection 16 at the bottom of the case 5 and a metal bearing 19 fitted in a projection 18 on the inside of the cover 6, a gear 21 rotatably mounted on said shaft 20, a fixed shaft 23 having one end fixed to a stepped elevated bottom 22 formed in the case 5 so as to lie parallel to the rotating shaft 20, a gear 24 rotatably mounted on the fixed shaft 23 and having the same diameter as gear 21 meshed therewith, and a worm wheel 26 made of a hard wear-resisting insulating material such as teflon.

The rotating shaft 27 of the motor 10 extends into the case 5 perpendicular to the shaft 20, with the extended end being supported by a bearing 28 provided in the case 5. A worm gear 29 formed on the extended portion engages with the worm wheel 26.

Figure 6:
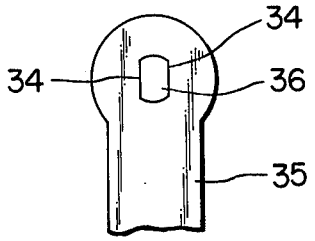
FIG. 6 is a cross-sectional view taken along the line C—C of FIG. 3.

Rotating shaft 20 has a stepped portion 32 between a small diameter portion passing through an axially long boss 30 of the gear 21 and a large diameter portion 31 passing through the metal bearing 19. A washer 33 contacting the stepped portion 32 and the metal bearing 17 prevent axial movement of the gear 21. As shown in FIG. 6, a pair of planes 34 are formed in that part of the large diameter portion 31 which is close to the stepped portion 32 to make the shaft cross-section flattened. The flattened shaft 36 is passed through a hole made in one end of an arm 35, so that rotating force is transmitted from the arm 35 to the rotating shaft 20. A spring washer 37 presses the arm 35 against a flange 38 formed on the large diameter portion 31 to prevent axial movement of the arm 35. The flange 38 contacts the metal bearing 19 to prevent outward movement of the rotating shaft 20.

One end of a link 42 is coupled with a projection 39 axially protruding from the gear 24 by means of a pin 40 and a screw 41. The base of a pin 43 is fitted to the other end of link 42 with a snap ring 45. The pin 43 and a screw 44 connect the arm 35 and link 42 together.

The rotating shaft 20 projects outwardly from the cover 6, with its extreme end forming a flattened portion 46. The flattened end 46 is press-fitted in a hole of the corresponding cross-section made in the lever 11, thereby fixing the lever 11 to the rotating shaft 20. A packing 48 fills an annular recession 47 formed in the cover 6, and is pressed by the lever 11 to seal the chamber 7.

Figure 7:
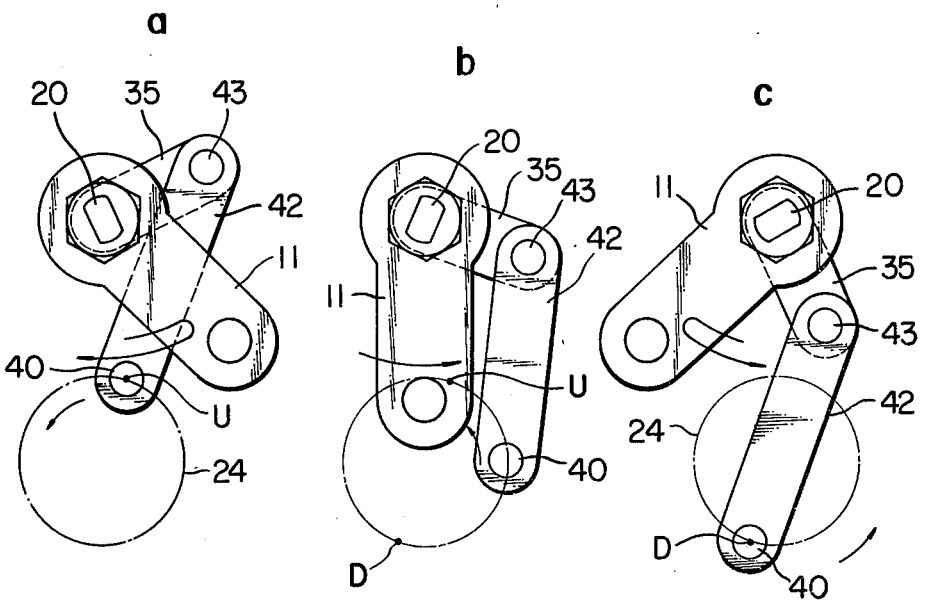
FIGS. 7(a), (b), and (c) illustrate the operation of a link mechanism.

When constructed as described above, the rotating gear 24 reciprocates the lever 11 through the arm 35 and link 42. As illustrated in FIG. 7, the lengths of the arm 35 and link 42 are dimensioned so as to turn with respect to each other at the top dead center U and at the bottom dead center D, thus, the motion of the lever 11 is reversed when the pin 40 passes the top U or bottom D dead center positions. Accordingly, as the gear 24 rotates, the lever 11 reciprocates within a given angular range, thereby moving the lever 2 between the starting-fuel-increasing position A and the fuel-shut-off position C, as described above.

Figure 8:
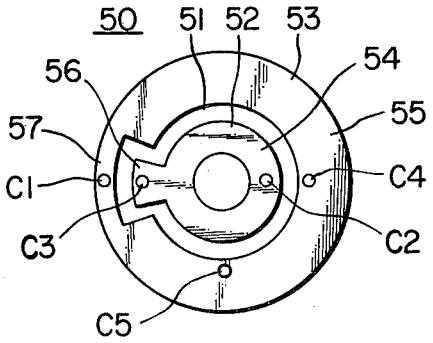
FIG. 8 is a front view of a pattern switch.

The rotating contact portion 50 of the pattern switch 9 is fixed to the worm wheel 26. As shown in FIG. 8, the rotating contact portion 50 comprises two electric-conducting plates 52 and 53 disposed flush but insulated from each other by a space 51. The annular portions 54 and 55 of the conducting plates 52 and 53, respectively, are concentric. The conducting plate 52 has a projection 56 protruding radially beyond the internal boundary of the annular portion 57 lying opposite to the projection 56 with the space 51 therebetween.

Figure 3:
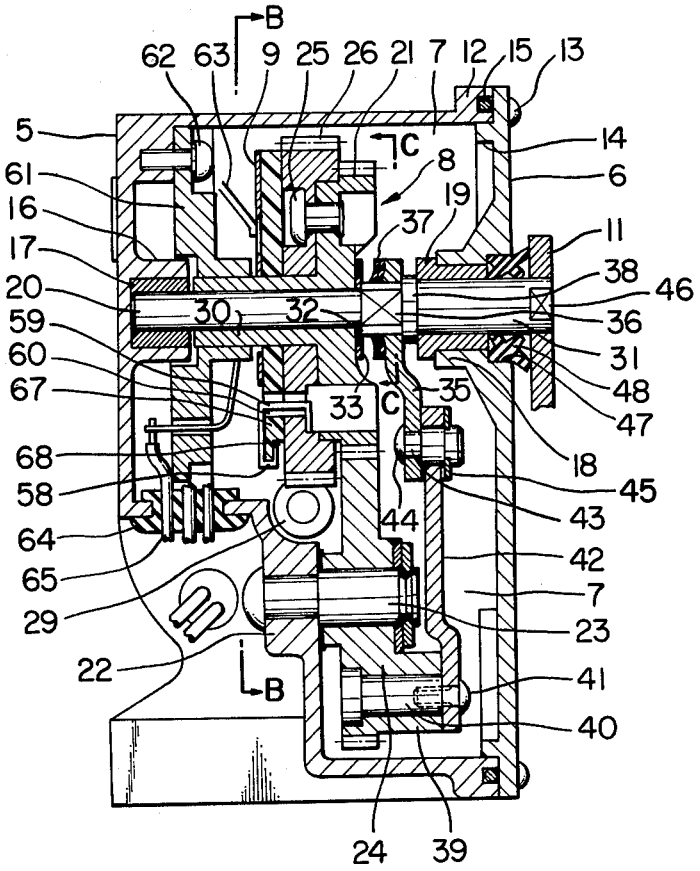
FIG. 3 is a cross-sectional view taken along the line A—A of FIG. 2.
Figure 4:
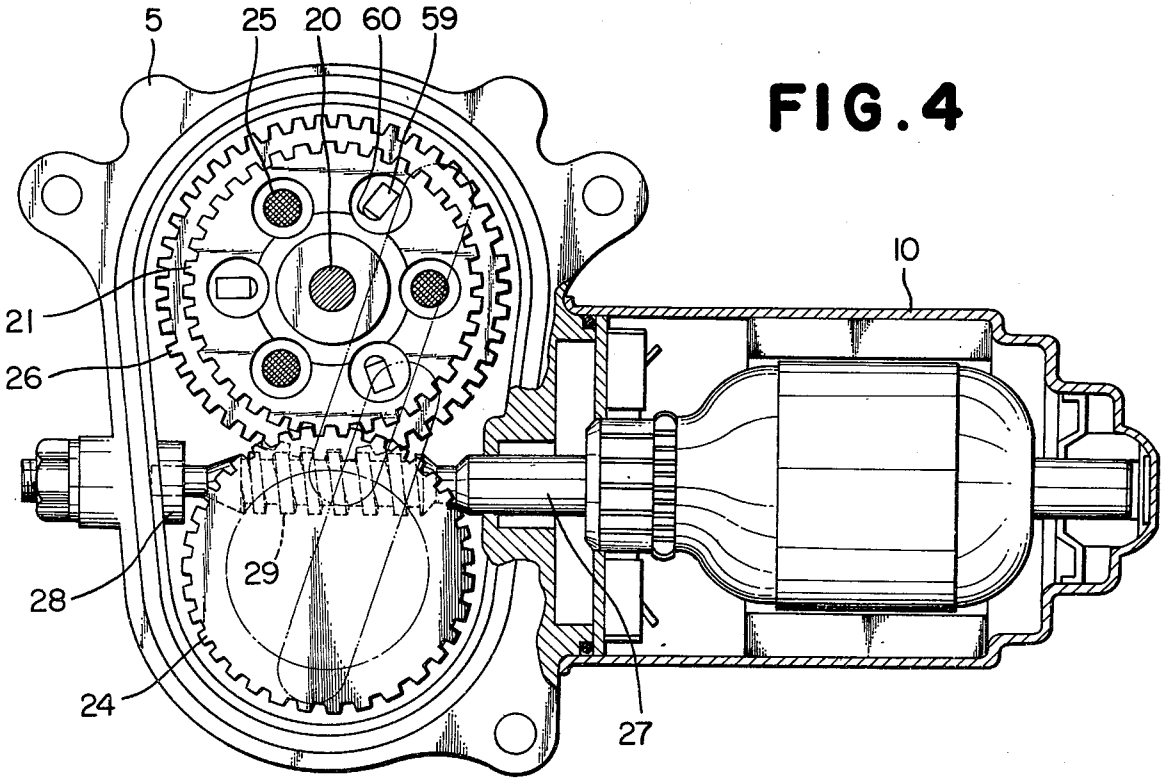
FIG. 4 is a front view showing the components of the mechanical assembly, with a part thereof cross-sectionally cut open.
Figure 5:
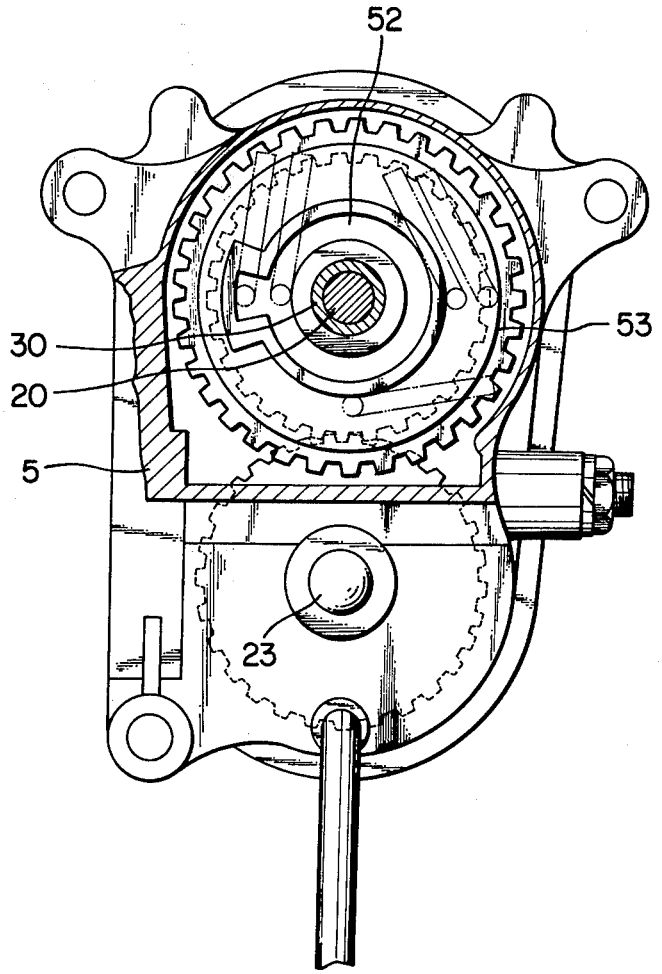
FIG. 5 is a cross-sectional view taken along the line B—B of FIG. 3.

The conducting plates 52 and 53 are fixed to the worm wheel by any suitable means. For instance, as shown in FIG. 3, the conducting plate 53 can be fixed by means of three short legs 58 and three long legs 59 formed integrally on the inside and outside of the annular portion 55, respectively. The short legs 58 are bent inward on the recess 68 in the reverse side of the insulated plate 67, and the long legs 59 are passed through holes 60 made in the worm wheel 26, with their projected ends bent on the opposite side of the worm wheel 26. The conducting plate 52 also can be fixed to the worm wheel 26 in the same manner.

An insulating plate 61 through which the rotating shaft 20 passes is fixed to the case 5 with a screw 62. One end of each of five contactors 63 of elastic metal is fixed to the insulating plate 61 and the other end is pressed against the rotating contact portion 50 to constitute the pattern switch 9 having five contacts C1 through C5 (FIG. 8). The contacts C1 and C2 are always in contact with the annular portions 55 and 54, respectively. The contacts C3, C4, and C5 each are spaced 90 degrees apart, so that they switchingly contact the annular portion 55 and the projection 56 as the rotating contact portion 50 turns. The contactors 63 connect with an external electric circuit as shown in FIG. 9 through lead wires 65 tightly passed through a rubber bushing 64 and wired to a connector 66.

Figure 9:
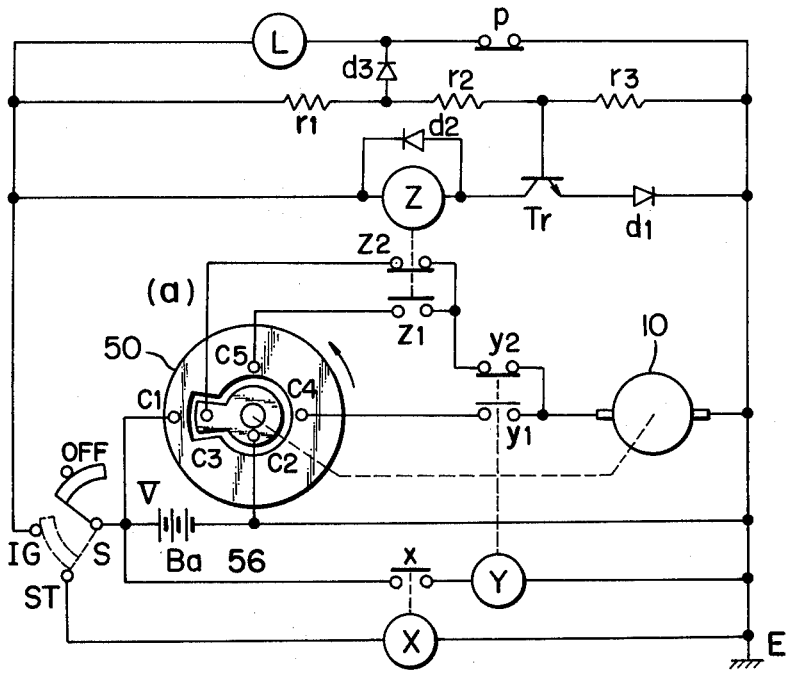
FIG. 9 is a motor control electric circuit diagram.
Figure 9:
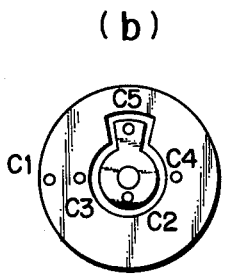
Figure 9:
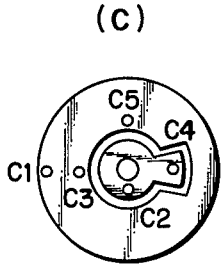

FIG. 9 shows an electric circuit of this invention. An auxiliary relay X, a first relay Y and a second relay Z, respectively, have a normally opened contact x, a normally opened contact y1 and a normally closed contact y2, and a normally opened contact z1 and a normally closed contact z2. Elements d1,d2 are diodes, while element p is a hydraulic switch adapted to open when the engine oil pressure rises to a given level, thus determining whether the engine is rotating or standing still (or reversing). Reference character L denotes a start indication lamp, Tr an npn - type transistor, r1, r2 and r3 voltage dividing resistors, and Ba a battery.

The operation of the fuel control apparatus according to this invention will now be described. The components of the electric circuit will be represented by their reference characters. Before starting, the engine is at rest and the pattern switch 9 is in the position (a) of FIG. 9 where the contact C3 contacts the projection 56, and the motor 10 is not energized. In this position, the pin 40 of the gear 24 is at the top dead center U positioning the lever 11 in the fuel-shut-off position, as shown in (a) of FIG. 7.

(1) On turning a key switch S to the starting position, a starting terminal ST and an ignition terminal IG connect with the battery Ba, thereby energizing X to close x, which, in turn, energizes Y to close y1 and open y2. Consequently, the power supply circuit encircling Ba-C1-C4-y1-motor 10-Ba closes to start the motor 10 which turns the pattern switch in the direction of the arrow. At the same time, the gear 24 also turns to the same angle as the pattern switch 9 in the direction indicated by the arrow in (a) of FIG. 7, thus moving the lever 11 to the left.

(2) When the pattern switch 9 has turned 180 degrees to the position (c) of FIG. 9, C1 and C4 are opened thereby opening the power supply circuit and closing the dynamic braking circuit encircling C2-C4-y1-motor 10-C2 to quickly stop the motor 10 by dynamic braking.

In this stop position, the pin 40 of the gear 24 reaches the bottom dead center D and the lever 11 stops in the starting-fuel-increasing position, as shown in (c) of FIG. 7.

When the engine has completed starting with increased fuel supply, the oil pressure rises to open p. Therefore, Tr conducts as a result of a rise in its base potential, thereby energizing z to close z1 and open z2.

(3) On returning the key switch S to open circuit ST and energizing only IG, X becomes deenergized to open x, whereby y deenergizes to open y1 and close y2. Then, the power supply circuit encircling Ba-C1-C5-z1-y2-motor 10-Ba closes to restart the motor 10. Consequently, the pin 40 of the gear 24 turns from the position (c) of FIG. 7 to the direction of the arrow, thus turning the lever 11 rightward.

(4) When the pattern switch 9 has turned 90 degrees to the position (b) of FIG. 9, C1 and C5 are opened to interrupt the supply of power to the motor 10. Simultaneously, C2 and C5 are closed to establish the dynamic braking circuit encircling C2-C5-z1-y2-motor 10-C2 to quickly stop the motor 10.

In this stop position, the pin 40 of the gear 24 reaches an angular position halfway between the top dead center U and the bottom dead center D as shown in (b) of FIG. 7, and the lever 11 stops in the normal-fuel-supply position (B).

(5) On returning the key switch S to the off position to stop the engine, Z becomes deenergized to open z1 and close z2. Consequently, the power supply circuit encircling Ba-C1-C3-z2-y2-motor 10-Ba closes to restart the motor 10. When the pattern switch 9 turns to the position (a) of FIG. 9, C1 and C3 are opened to cut the supply of power to the motor 10. At the same time, the dynamic braking circuit encircling C3-z2-y2-motor 10-C2 is established to quickly stop the motor 10.

In this stop position, the pin 40 of the gear 24 reaches the top dead center U shown in (a) of FIG. 7, and the lever 11 stops in the fuel-shut-off position.

The above-described fuel control apparatus of this invention permits the use of a simple motor control circuit, since the fuel control lever is moved by a motor which rotates in one direction. Further, the quantity of fuel supply can automatically be switched from the increasing starting level to the normal operation level or interrupted by the operation of the pattern and key switches which are actuated by the motor from the start to the normal operating period of the engine.

What is claimed is:

1. A fuel control apparatus for a diesel engine comprising a motor having a shaft which rotates in one direction, a link having one end rotated by said motor shaft and the other end connected with an arm, a fuel control lever which moves between a fuel-shut-off position and a starting-fuel-increasing position in response to the motion of said rotating shaft connected with said arm, a key switch, a pattern switch which rotates co-angularly with rotation of said motor shaft, means for providing an indication of whether said engine is rotating or at reast, and a control circuit responsive to a first angular position of said pattern switch and the movement of said key switch to a start position for starting the motor thereby moving said fuel control lever from said fuel-shut-off position to said starting-fuel-increasing position and angularly moving said pattern switch until said pattern switch reaches a second angular position, said control circuit being responsive to said pattern switch reaching said second angular position for stopping said motor, said second angular position of said pattern switch corresponding to the starting-fuel-increasing position of said fuel control lever, said control circuit being further responsive to the movement of said key switch from said start position to an operative position and to an indication that said engine is rotating provided by said means for providing for restarting said motor, thereby rotating said pattern switch until said pattern switch reaches a third angular position and said fuel control lever is correspondingly in a normal fuel supply position, said control circuit being responsive to said pattern switch reaching said third angular position for stopping said motor, said control circuit being further responsive to movement of said key switch from an operating to a cut-off position for restarting said motor, said motor rotating said pattern switch and moving said fuel control lever toward said fuel shut off position until said pattern switch reaches first angular position corresponding to said fuel control lever being in said shut-off position, said control circuit being responsive to said pattern switch reaching said first angular position for stopping said motor.

2. A fuel control apparatus for a diesel engine comprising:

a motor having a shaft which rotates in one direction, a link having one end rotated by said motor shaft and the other end connected with an arm, a fuel control lever connected to said arm moving in response to the rotation of said motor shaft, and means for intermittently operating said motor to cause said shaft to rotate, a first portion of said shaft rotation causing said fuel control lever to move from a fuel shut-off condition to a starting-fuel-increasing position, a second portion of said shaft rotating causing said fuel control lever to move from said starting-fuel-increasing position to a normal fuel supply condition and a third portion of said shaft rotation causing said fuel control lever to move from said normal fuel supply position to said fuel shut-off position.

3. A fuel control apparatus as in claim 2 wherein said means for intermittently operating said motor comprises:

a pattern switch rotating co-angularly with said shaft, a key switch, a means for indicating that said engine is rotating, and a control circuit responsive to said key switch, pattern switch and means for indicating for intermittently controlling the energization of said motor, thereby intermittently moving said fuel control lever.

4. A fuel control apparatus as in claim 1 wherein said control circuit includes a dynamic brake circuit which is connected to said motor when said motor is stopped by said control circuit.

5. A fuel control apparatus as in claim 3 wherein said control circuit comprises a source of potential, a first relay connected across said source of potential and actuated when said key switch is in a starting position, a second relay connected across said source of potential and actuated when said first relay is actuated, said second relay having a normally open and a normally closed pair of contacts, each pair of contacts having one terminal connected to a first terminal of said motor, a second terminal of one of said pair of contacts being connected to a first position on said pattern switch and a second terminal of said other pair of contacts being connected to a first contact of each of a pair of normally open and normally closed contacts of a third relay, a second contact of each of said pairs of contacts of said third relay being connected to respective second and third positions on said pattern switch, said third relay adapted to be coupled across said source of potential when said key switch is in an operating position and said means for indicating indicates that said engine is rotating, a first conductor connecting a second terminal of said motor to said one side of a source of potential, a second conductor connecting said one side of said source of potential to a fourth position on said pattern switch, and a third conductor connecting the other side of said source of potential to a fifth position on said pattern switch.

6. A fuel control apparatus as in claim 5 wherein said pattern switch comprises an outer conductive band having a notch therein, an inner conductive band having a projection which fits in said notch, and an insulating material between said outer and inner conductive bands.

* * * * *